US005218578A

United States Patent [19]

Perucchi

[11] Patent Number: 5,218,578

[45] Date of Patent: Jun. 8, 1993

[54] DISPLAY DEVICE IN OR FOR USE IN A TIMEPIECE

[75] Inventor: Norberto Perucchi, Saint-Blaise, Switzerland

[73] Assignee: Gianni Bulgari S.p.A., Rome, Italy

[21] Appl. No.: 961,254

[22] Filed: Oct. 15, 1992

[30] Foreign Application Priority Data

Oct. 17, 1991 [CH] Switzerland ..... 03048/91

[51] Int. Cl.[5] ..... G04B 19/20

[52] U.S. Cl. ..... 368/37

[58] Field of Search ..... 368/28, 35-39

[56] References Cited

U.S. PATENT DOCUMENTS

| | | | |
|---|---|---|---|
| 2,976,672 | 3/1961 | Ducommun | 368/37 |
| 3,901,017 | 8/1975 | Erni et al. | 368/37 |
| 4,026,100 | 5/1977 | Kume et al. | 368/35 |
| 4,674,889 | 6/1987 | Klaus | 368/28 |

FOREIGN PATENT DOCUMENTS

| | | |
|---|---|---|
| 849199 | 1/1939 | France . |
| 660941 | 12/1987 | Switzerland . |

*Primary Examiner*—Vit W. Miska

*Attorney, Agent, or Firm*—McGlew and Tuttle

[57] ABSTRACT

The display of n+m symbols is achieved by means of an upper disk (1*a*), placed behind an aperture (2) in a cover plate, and of a lower disk (1*b*), placed behind the upper disk and comprising m sectors.

One sector of the upper disk (1*a*) consists of a transparent window (4), the other n+m sectors of the two disks bearing the symbols.

A gear-train (11, 12*a*, 12*b*, 13*a*, 13*b*) and a control cam (20), set in motion by a rotary driving member (10), cause the disks to rotate in steps of one sector, starting from a position in which the window (4) is located behind the aperture (2), such as to cause first the two disks to move forward together by one step, then the upper disk (1*a*) to move forward n successive steps, and finally the lower disk (1*b*) to move forward m−1 successive steps to return to the starting position.

A positioning device (30*a*, 30*b*, 31*a*, 31*b*) blocks the disks (1*a*, 1*b*) when they are stationary, and releases them when required to move forward.

13 Claims, 5 Drawing Sheets

DISPLAY DEVICE IN OR FOR USE IN A TIMEPIECE

BACKGROUND

The present invention relates to a mechanical device for cyclically displaying a series of symbols, one after another, behind an aperture in a cover plate. It relates more particularly to a device comprising a pair of superposed annular disks intended to display information in the aperture of the dial of an analog timepiece, e.g. the date, by means of numerals of substantially larger size than those of conventional single-disk calendars. The invention also relates to a device for quickly correcting the position of the disks.

Calendars that resort to a pair of superposed annular discs to increase the size of the numerals are known. Swiss patent specification 660941, for instance, describes in detail one embodiment of such a calendar in the case of a wristwatch. In this embodiment, the lower disk comprises 17 equal sectors, the first 16 bearing numbers 1 to 16, the last being blank. The upper disk comprises 16 sectors, the first being a window that enables the numerals of the lower disk to become apparent, whereas the following 15 sectors bear numbers 17 to 31. The device further comprises a driving mechanism, within the disks, for rotating the disks in steps of one sector off the hours staff of the watch's movement. At the start, the two disks are in an initial position in which the window and the number 1 are opposite the dial aperture which thus displays the ordinal of the first day of a month. The mechanism first only drives the lower disk through 16 successive steps. Thus, while the upper disk is at rest, the first 15 steps cause numbers 2 to 16 to succeed one another behind the window and the aperture after the number 1 that was visible in the initial position. During the 16th step a shoulder on the lower disk abuts against a similar shoulder on the upper disk to cause the latter to move forward one step. Thus, at the end of the 16th and final step, number 17 of the upper disk that is directly visible and the blank sector of the lower disk that is hidden by the other disk are in register with the aperture. The mechanism then only drives the upper disk through 15 successive steps. Thus, while the lower disk is at rest, the first 14 steps cause numbers 18 to 31 to follow one another behind the aperture. During the 15th step, the above mentioned shoulder on the upper disk abuts against the shoulder of the lower disk to cause the latter to move forward one step. At the end of the 15th and final step the two disks will then be back in their initial position, with the window of the upper disk and the number 1 of the lower disk in register with the aperture. Finally, to avoid accidental movement of the disks as a result of a shock, the device comprises a pair of conventional jumpers, each serving to position one disk.

The cited document also describes a further embodiment in which the upper disk comprises two windows, the lower disk remaining unchanged. With appropriate shoulders, it then becomes possible to display the numbers from 1 to 31 or from 1 to 30, i.e., more generally, both the odd numbers and the even numbers.

The embodiments disclosed in the cited document do however suffer from a number of drawbacks. In particular, the lower disk comprises a blank or void sector, and in the second embodiment the upper disk moreover has a second window. The presence of the void sector and of the second window reduces the space available for the numerals and hence means having to reduce the size of the latter. This runs counter to the object of the invention. Further, because of the central arrangement of the drive mechanism, the disks can be made to have quite a large diameter. But since the moment of inertia of a disk increases to the power four of its radius, the positioning of a large disk requires the jumper to exert much pressure on the disk, hence involving considerable frictional forces. Such frictional forces reduce of course the operational reliability of the watch, particularly at those times when both disks are being driven at the same time.

SUMMARY

An object of the invention is to provide a two-disk display device that does not suffer from these drawbacks.

To this end, there is provided a display device in or for use in a timepiece having an analog movement and comprising an upper disk having a transparent window and which is located behind a cover plate having an aperture, a lower disk concentric with the upper disk, the latter covering at least partially the lower disk of which a portion is visible through the window, means for rotatably driving step by step each disk about an axis in a given direction from a rotary element of the timepiece's movement, and means for positioning the disks, characterized in that:

the upper disk is divided into n+1 equal and adjacent sectors respectively designated by the numbers 0', 1', . . . , n' such as to travel past the aperture in ascending number order behind the cover plate when the disk rotates in one of the given directions, sector 0' having the window and the other sectors bearing distinguishing symbols;

the lower disk is divided into m equal and adjacent sectors bearing distinguishing symbols respectively designated by the numbers 1'', 2'', . . . , m'' such as to travel past the aperture in ascending number order behind the upper disk when the lower disk rotates in the other given direction;

the means for driving the disks are arranged, starting from an initial position in which sectors 0' and m'' are in register with the aperture:

a) to move the upper disk forward by n+1 successive one-sector steps to cause the n sectors 1', 2' . . . n' to travel past the aperture behind the cover plate, and to reset the sector 0' in the starting position after a complete revolution of the disk, b) to move the lower disk, while the upper disk is moving, by one one-sector step such that the sector 1'' will find itself opposite the aperture, at the same time as the sector 0', at the end of the complete revolution of the upper disk, and c) to move only the lower disk by m−1 successive one-sector steps to cause the sectors 2'', 3'', . . . m'' to travel past the aperture and the window behind the upper disk and return to the initial position at the end of the last step after the n+m sectors 1', 2' . . . , n', 1'', 2'', . . . , m'' have travelled past either the aperture or the aperture and window; and in that the positioning means block the disks when they are at rest, and release the disk or disks having to move.

One advantage of the invention is that all sectors, except that with the window, are used to display symbols.

Another advantage is that while in their rest position the disks are blocked, thereby ensuring reliable positioning, whereas nothing will hinder the movement of the disk carrying out a step.

Other features and advantages of the display device according to the invention will become apparent from the following description of one embodiment given by way of example.

DRAWINGS

In the drawings, where the same reference relate to similar elements:

FIG. 1 diagrammatically illustrates a preferred embodiment of the display device according to the invention in the case of a calendar watch, both disks being in a position taken as the initial position of the device;

DESCRIPTION

The display device according to the invention will be described here in detail in the case of a wrist-watch calendar device. This calendar device may either form part of the watch's movement or consist of a module that can be fitted to an existing watch. If the device forms part of the movement, rapid date setting of the calendar can be done by means of the watch's crown or winding-button, acting on mechanisms that are known per se. But if it consists of an independent module, the latter preferably includes a date setting mechanism operated by a push-piece of which one embodiment will also be described.

The present calendar device could of course readily be adapted to display information other than the ordinal of the day of a the month, e.g. the time.

Figure 1:
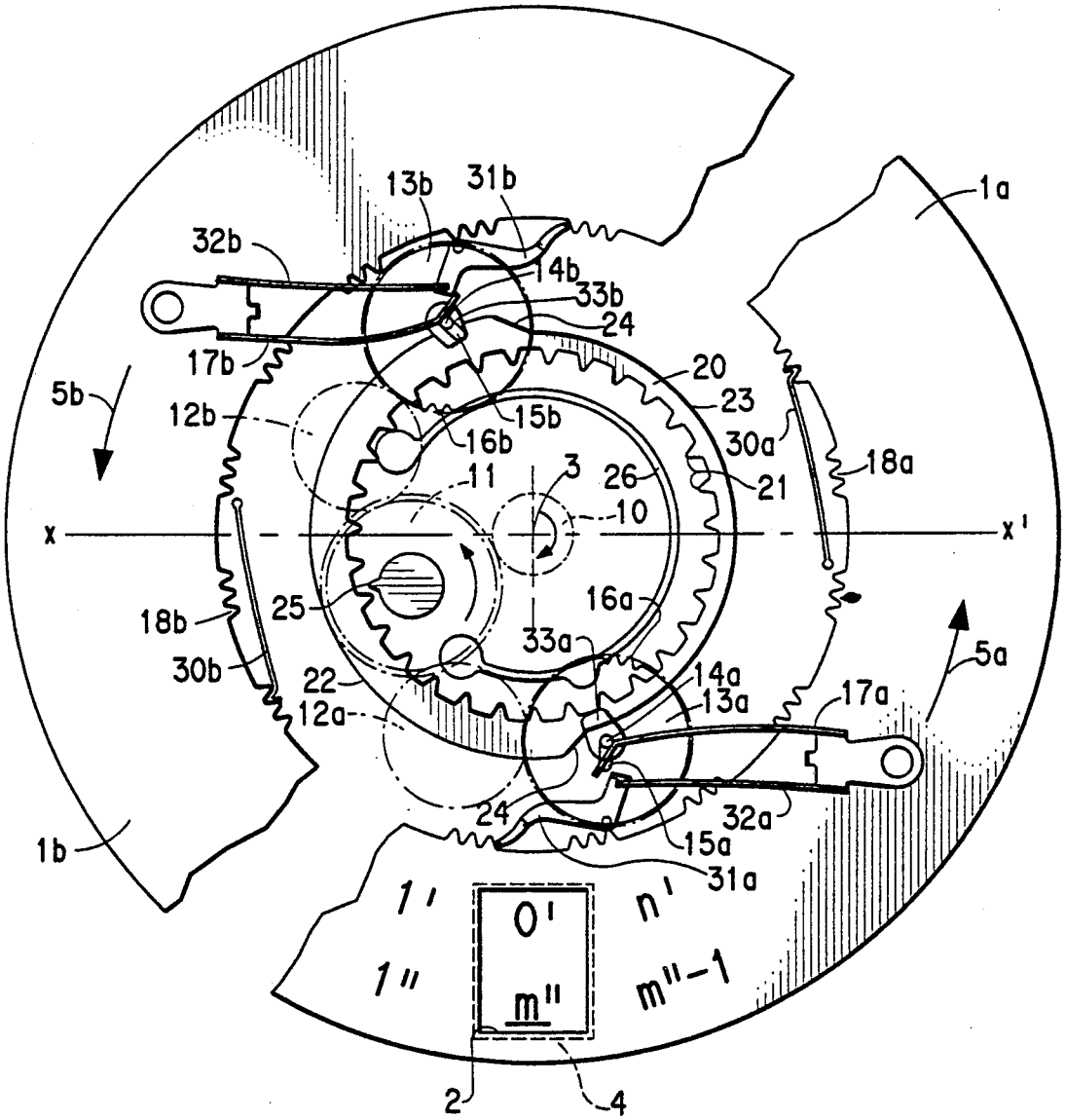

FIG. 1 illustrates an embodiment of a calendar device incorporating the invention. In this figure reference 1*a* designates an upper annular disk, similar to a conventional calendar disk, which covers a lower annular disk 1*b*. The two disks, which are here identical although this is not essential, are concentrically arranged so that they can rotate about a common axis 3. Each disk is divided into 16 equal sectors that are adjacent to one another, each sector, except one in disk 1*a*, bearing the ordinal number of a 31-day month. A dial, not shown, formed with an aperture 2 covers the upper disk 1*a* so that the ordinal numbers of this disk, when it is rotating, appear one by one in this aperture. The blank sector of upper disk 1*a* comprises a transparent window 4 and this window, when in register with aperture 2, enables the ordinal numbers of lower disk 1*b* to be read one by one.

Disks 1*a* and 1*b* are both rotated by a drive mechanism, described later, able to rotate each disk in one-sector steps in a given direction, this direction being indicated by arrow 5*a* for disk 1*a* and arrow 5*b* for disk 1*b*. In the present embodiment the disks rotate in the same direction but they could also rotate in opposite directions.

The sectors of upper disk 1*a* bear ordinal numbers 1 to 15, not shown. These numbers are arranged to travel in an ascending order past aperture 2, behind the dial, when disk 1*a* is rotating in direction 5*a*. Similarly, the sectors of lower disk 1*b* bear ordinal numbers 16 to 31, also not shown, these numbers travelling in an ascending order past aperture 2, behind disk 1*a*, when disk 1*b* is rotating in direction 5*b*. Thus, numerals 1 to 15 are directly displayed through aperture 2 and numerals 16 to 31 are displayed through both the aperture 2 and the window 4.

Considered more generally, since the present display device can display information other than the ordinals of the days of a month, it will hereinafter be assumed that that disk 1*a* is divided into n+1 equal and adjacent sectors, and that disk 1*b* is divided into m other equal and adjacent sectors. These sectors are referenced in ascending number order, as before, from 0′ to n′ for the first series, and from 1″ to m″ for the second series, sector 0′ having window 4 and the n+m sectors each bearing a distinctive symbol. In the case of a calendar, 1′ to n′ would bear ordinal numbers 1 to 15, and sectors 1″ to m″ would bear ordinal numbers 16 to 31.

For the n+1 sectors of disk 1*a* and then the m sectors of disk 1*b* to appear cyclically through aperture 2 in an increasing order of the references from an initial position, the two disks must be timely moved by the drive mechanism.

The initial position is arbitrary and in the present embodiment is chosen to be that in which sectors 0′ and m″ are both in register with aperture 2. Had another position been chosen for the initial position, the disks obviously would, after a certain number of steps, necessarily come to be located in corresponding positions in the previously defined initial position. Consequently, since the display device operates cyclically, it suffices to define the sequence of the disks' movements from one initial position, the sequences for other initial positions being readily deducible from it.

Figure 2:
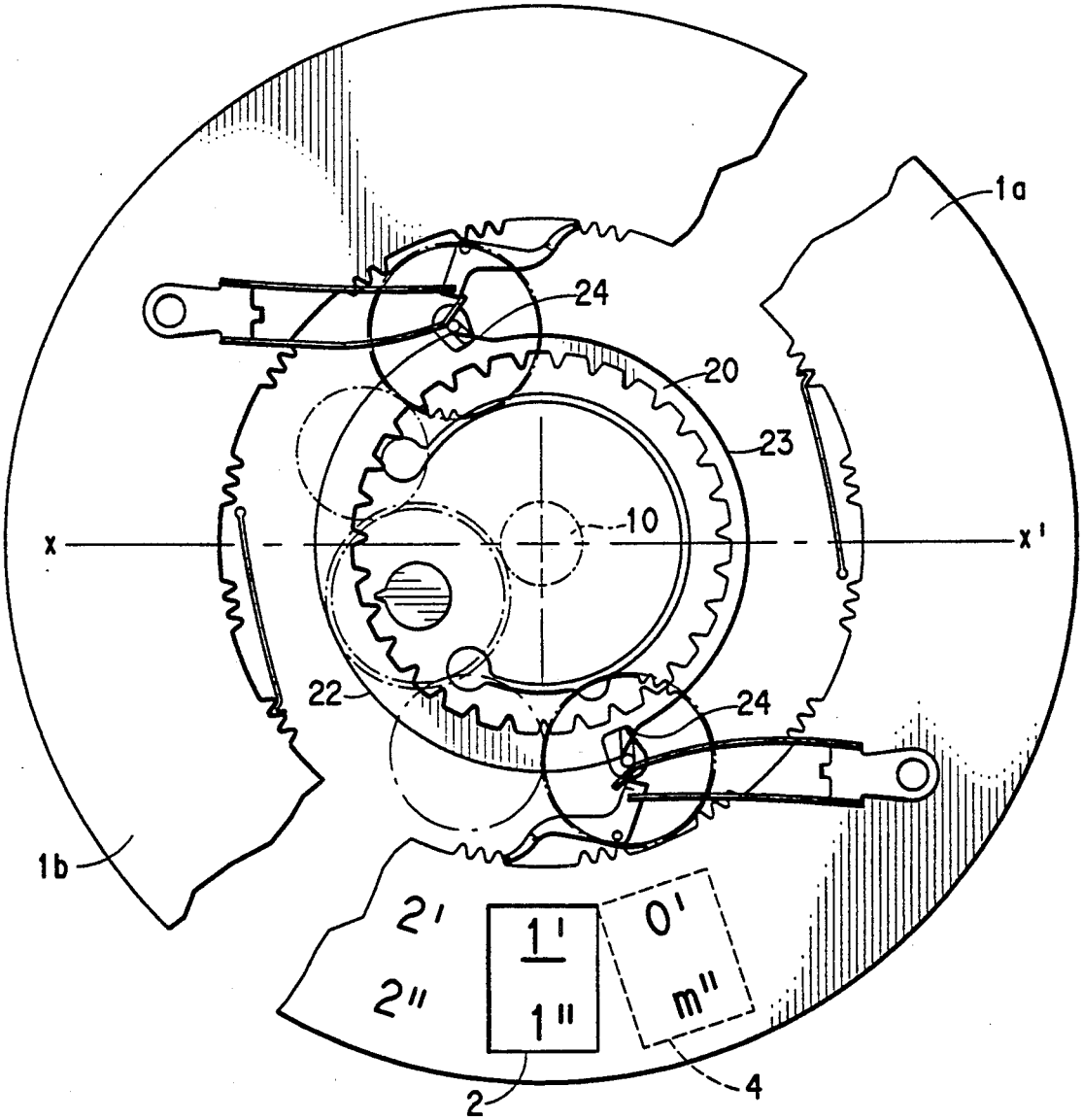
FIG. 2 shows the calendar device illustrated in FIG. 1 after operating for 24 hours.
Figure 3:
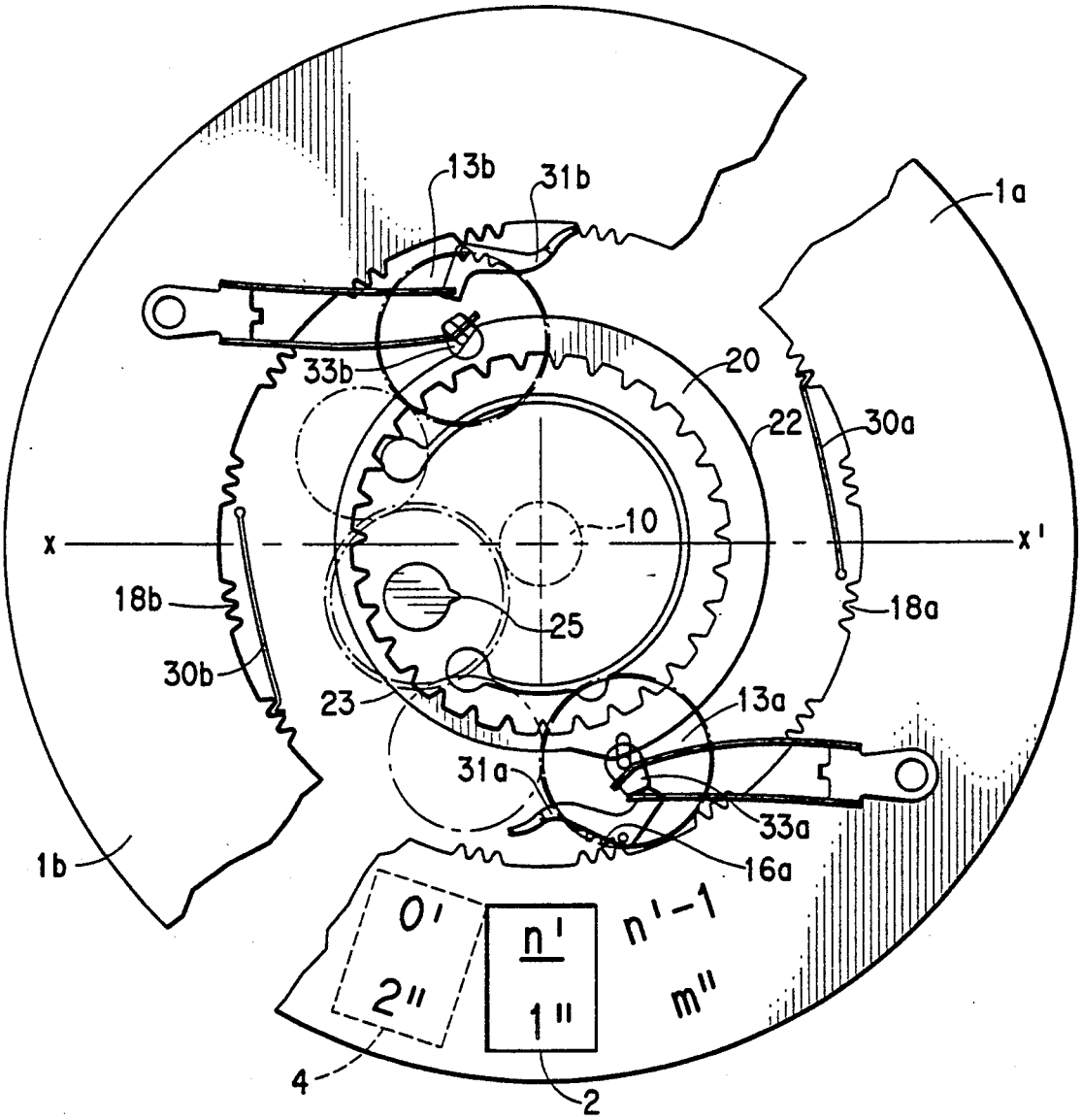
FIG. 3 shows the calendar device of FIG. 1 after 15 steps.

In the embodiment of the display device shown in FIGS. 1, 2 and 3, the function of the drive mechanism, from the initial position shown in FIG. 1, in which only sector m″ is visible, is to advance disk 1*a* by n+1 successive one-sector steps to reset it in the starting position after one complete revolution, to advance disk 1*b* by one one-sector step while disk 1*a* is doing the first step, and to advance only disk 1*b* by m−1 successive one-sector steps to return to the initial position at the end of the last step.

To so actuate the disks, the drive mechanism comprises a gear-train having a first toothed wheel 10 fitted on the hours staff of the watch's movement (not shown), the axis of this staff coinciding with the axis of rotation 3 of the disks. A second toothed wheel 11 meshes with wheel 10 and with first and second intermediate toothed wheels 12*a* and 12*b*. Further, first and second toothed driving wheels 13*a* and 13*b* respectively mesh with toothed wheels 12*a* and 12*b*. The gear ratios of the various toothed wheels are so selected that the second toothed wheel 11 and the driving wheels 13*a* and 13*b* perform, in the case of a calendar, one revolution in 24 hours, the direction of rotation being anticlockwise in the present embodiment.

Wheel 13*a* rotates about a staff 14*a* arranged at right angles to the planes of disks 1*a* and 1*b* in an elongated opening 15*a*. Opening 15*a* enables wheel 13*a* to move in a substantially radial direction in relation to axis 3, while remaining in meshing engagement with toothed wheel 12*a*. The wheel 13*a* can thus move between an inoperative position, close to axis 3, and an operative position, remote from axis 3. Wheel 13*a* further has on its periphery at least one radial finger 16*a* in the plane of disk 1*a*, this plane being different from that of wheel 12*a*. Moreover, staff 14*a* is acted on by a spring 17*a* urging wheel 13*a* to its inoperative position.

The inner perimeter of disk 1*a* is formed with n+1 regularly spaced toothed sectors 18*a* able to mesh with fingers 16*a* when wheel 13*a* is in its operative position. This meshing occurs once per revolution of wheel 13*a*, i.e. once every 24 hours, and when it happens wheel 13*a* drives disk 1*a* through a one-sector step in the direction of arrow 5*a*. But when wheel 13*a* is in its inoperative position, it cannot mesh with sector 18*a* and disk 1*a* then remains idle.

Similarly, disk 1*b* is formed on its inner perimeter with m regularly spaced toothed sectors 18*b*. Between disk 1*b* and the second toothed wheel 11 are provided elements 12*b* to 17*b*. These elements are not described as they are identical to the corresponding elements 12*a* to 17*a* discussed above.

Toothed wheels 13*a* and 13*b* are moved to their operative positions by an annular cam 20 rotating about axis 3 concentrically with disks 1*a* and 1*b*. The inner perimeter of cam 20 is formed with n+m regularly spaced teeth 21, whereas its outer perimeter is divided into a first, circular, actuating sector 22 and a second, circular, passive sector 23, the radius of the second sector being less than that of the first. One sector is linked to the next by an inclined plane 24 which extends over an arc having a magnitude less than or equal to that of the arc between two consecutive teeth 21. Cam 20 is rotated by a catch 25 which is solid with toothed wheel 11 and which engages, at each revolution of wheel 11, one of the teeth 21 to move cam 20 forward one step, wheel 11 performing one revolution every 24 hours in the case of a calendar. Moreover, a jumper 26 positions cam 20 by acting on teeth 21 but with only moderate pressure as the moment of inertia of the cam is very small.

The staffs 14*a* and 14*b* of wheels 13*a* and 13*b* are urged against sectors 22 and 23 of cam 20 by springs 17*a* and 17*b*, the radiuses of these sectors being so chosen as to put into operative position the wheel whose staff touches sector 22, and into its inoperative position if this staff touches sector 23. The lengths of sectors 22 and 23 and the angle formed by straight lines joining axis 3 to staffs 14*a* and 14*b*, are governed by the sequence of movements having to be made by disks 1*a* and 1*b* during a complete working cycle of the display device. In the case of the calendar device shown in FIGS. 1 to 3, sector 22 extends over an arc of 178 degrees, and the angle between the above straight lines is 174 degrees.

The operation of the drive mechanism described above will now be explained with reference to the calendar shown in different states in FIGS. 1, 2 and 3.

FIG. 1 shows the calendar, in the initial state, at about noon. Sectors 0′ and m″ of disks 1*a* and 1*b* are then behind aperture 2. Since sector 0′ has window 4, it is sector m″, bearing number 31 not shown, that is visible. Cam 20 occupies a position in which the staff 14*a* of wheel 13*a* bears against the end of sector 23 and in which the staff 14*b* of wheel 13*b* bears against the end of actuating sector 22. The fingers 16*a* and 16*b* of these wheels are remote from disks 1*a* and 1*b* and the catch 25 of wheel 11 is about to engage a tooth 21 of cam 20. For about the following four hours, catch 25 drives cam 20 to move it by one tooth and put it in the position shown in FIG. 2. Wheels 13*a* and 13*b* are then both in their operative position, whereas disks 1*a* and 1*b* have remained in their initial position. This state of affairs lasts for about 24 hours. At that time, the angular position of wheels 11, 13*a* and 13*b*, which have carried on rotating, is that shown in FIG. 3, where disks 1*a* and 1*b* do not however occupy the initial position because it represents the calendar in a state it will only have later. Catch 25 is removed from cam 20 and fingers 16*a* and 16*b* are on the point of meshing with corresponding sectors 18*a* and 18*b* to drive, for about four hours, disks 1*a* and 1*b* by one one-sector step respectively in the direction of arrows 5*a* and 5*b*, and cause the calendar to move from its initial position to the following position.

This new position of calendar disks 1*a* and 1*b* is shown in FIG. 2, when it is about noon. The calendar is now in a state when sectors 1′ and 1″ are behind aperture 2, sector 1′ bearing number 1, not shown, and sector 1″ bearing number 16 masked by disk 1*a*. Exactly 24 hours have thus elapsed between the positions of disks 1*a* and 1*b* in FIG. 1 and FIG. 2, and during this time the calendar has moved from the thirty-first to the first of the following month.

Catch 25 then drives, as before, cam 20 forward by one tooth in about four hours. Wheel 13*b* then moves from its operative position to its inoperative position, its staff leaving the end of the actuating sector 22 to bear against the beginning of sector 23, whereas wheel 13*a* remains in its operative position. At about midnight, wheel 13*a* begins to drive disk 1*a* to move it by one step and cause sector 2′ bearing number 2 not shown, behind aperture 2, while disk 1*b* remains stationary, wheel 13*b* being in its inoperative position.

Disk 1*a* is then moved in the same way every 24 hours at about midnight, while disk 1*b* is at rest, until sector n′, bearing number 15 not shown, comes to be located behind aperture 2. This position of the calendar is shown in FIG. 3, when it is about midnight. As wheel 13*a* still is in its operative position and wheel 13*b* still is in its inoperative position, only disk 1*a* is stirred during the next four hours to move sector 0′ behind aperture 2 and allow sector 1″ bearing number 16 not shown, to be displayed.

From the initial position, disk 1*a* has thus moved forward n+1 steps and hence performed one complete revolution after having displayed days 1 to 15 of a month, whereas disk 1*b* has only moved forward one step, at the same time as the first step of disk 1*a*.

With cam 20 being in the position shown in FIG. 3, the staffs of wheels 13*a* and 13*b* respectively bear on the end portions of sectors 22 and 23. Cam 20 is then driven at about noon by one step, hence causing wheel 13*a* to move to its inoperative position and wheel 13*b* to move to its operative position. Thus, at about midnight, while disk 1*a* is stationary, disk 1*b* is moved forward by one step to position sector 2″ bearing number 17, not shown, behind aperture 2 and window 4. Disk 1*b* is then moved in the same way every 24 hours until sector m″, bearing number 31 not shown, comes to be positioned behind aperture 2 after one complete revolution of the disk. Both disks 1*a* and 1*b* will then have returned to their initial position shown in FIG. 1, this position being the start of a new cycle.

From the above description, it will be seen that cam 20 is driven one step every 24 hours at about noon, whereas disks 1*a* and 1*b* may be driven, depending on the operative or inoperative position of toothed wheels 13*a* and 13*b*, by one step every 24 hours at about midnight, each rotation of the cam or of the disks lasting in the present case about four hours. Starting from the initial position shown in FIG. 1, disks 1*a* and 1*b* are first driven together one step, disk 1*a* is then driven one step alone, whereupon disk 1*b* is driven m−1 steps alone, both disks then ending up in their initial position.

Clearly, the timing of the cam's forward movement by one step and the time taken to rotate the cam and the disks 1*a* and 1*b* through one step could be other than what has been described. Further, the first step of disk 1*b* after the initial position need not coincide with the first step of disk 1, but could occur at any time during the time interval when the latter disk displays days 1 to 15 of a month. In fact, the position and the rotation of disk 1*b* can be freely chosen as long as sector 0' of disk 1*a* is not in register with aperture 2.

When fingers 16*a* and 16*b* are not in engagement with the corresponding toothed sectors 18*a* and 18*b*, disks 1*a* and 1*b* are free and could rotate under the effect of an angular acceleration which is bound to happen when the watch is worn. To avoid such undesirable rotational movements the disks could be positioned with conventional jumper-springs, but such an arrangement suffers from drawbacks as indicated earlier. That is why, in this embodiment, use is made of a positioning device that blocks the disks when at rest and releases them when required to move forward.

To this end, one end of an elastic jumper 30*a* is made to bear, with slight pressure, against a tooth of one sector 18*a* of disk 1*a*. Jumper 30*a* is arranged to enable the disk to rotate with practically no resistance in the direction of arrow 5*a* and to prevent it from rotating in the opposite direction by bracing itself against the tooth. Such a jumper is termed for that reason a unidirectionally acting jumper, or click jumper. A rigid lever 31*a*, that pivots in the plane of disk 1*a*, is moreover provided near toothed wheel 13*a* with one of its ends bearing against a tooth of another sector 18*a* of disk 1*a* to stop it from rotating in a direction opposite to arrow 5*a*. A spring 32*a* keeps the lever in this position by acting on its other end. Disk 1*a* is thus blocked in both directions of rotation, as shown in FIGS. 1 and 2.

To enable disk 1*a* to move one step in the direction of arrow 5*a* at the required time, wheel 13*a* has a finger 33*a* which engages, at about midnight and only when wheel 13*a* is in its operative position, the other end of lever 31*a*. Under the action of finger 33*a*, lever 31*a* then rocks to move its one end away from the tooth it is engaging, at the time when fingers 16*a* are on the point of meshing with a sector 18*a* to drive disk 1*a* one step, as shown in FIG. 3.

Disk 1*b* is also provided with positioning members 30*b* and 31*b* but these will not be described as they are similar to the members 30*a* and 31*a* just described. In FIG. 3, wheel 13*b* is in its inoperative position. Finger 33*b* does not therefore touch lever 31*b* which hence blocks disk 1*b* whereas disk 1*a* is free to rotate.

A mechanism for rapidly correcting the positions of disks 1*a* and 1*b*, i.e. the date in the present instance, will now be described with reference to FIGS. 4 and 5. This mechanism may with advantage form part of the display device when the latter is a module.

Figure 4:
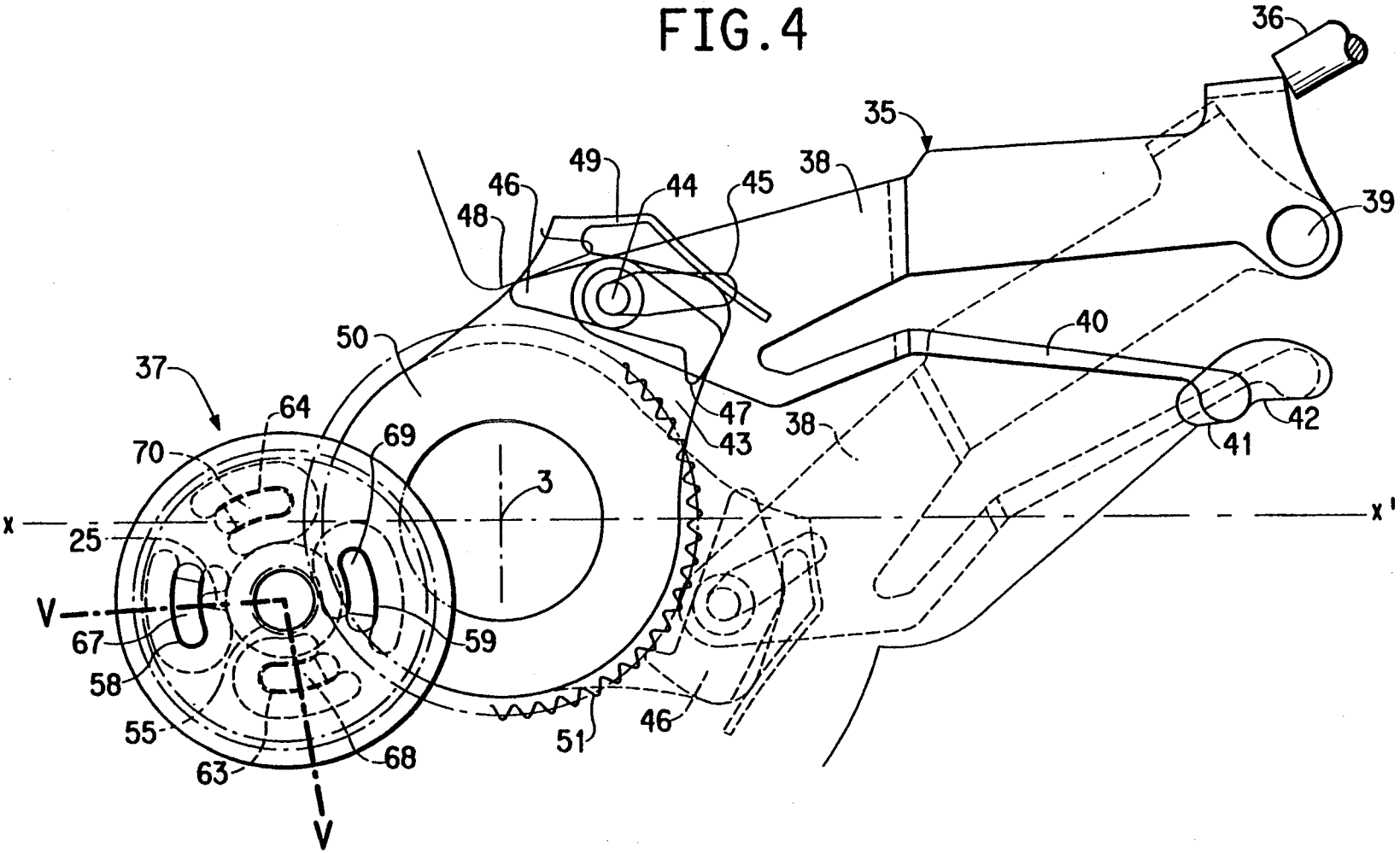
FIG. 4 is a plan view of a disk correcting mechanism of the display device.

In the preferred embodiment, the disk-correcting mechanism, shown in plan in FIG. 4, comprises an actuating mechanism 35 responsive to the action of a push-piece 36 accessible from outside the watch, and a clutch mechanism 37 for either normally driving the intermediate toothed wheels 12*a* and 12*b* and cam 20 off toothed wheel 10, or for driving these rotary parts in accelerated fashion in response to pressure on push-piece 36.

Push-piece 36 acts on a correcting lever 38 to cause it to pivot about an arbor 39 from a first, rest, position to a second, terminal, position represented in broken lines in FIG. 4. Lever 38 is maintained in its rest position, when no pressure is exerted on push-piece 36, by a spring 40 that is solid with lever 38 and whose free end bears against a surface 41 of the frame, not shown, of the correcting mechanism. This surface has a boss 42 producing a hard point or resistance at the start of the lever's travel. To overcome this resistance and set the lever in motion, an initial pressure must be applied to push-piece 36, this pressure being so chosen as to avoid all risk of accidental or incomplete correction of the disks.

Lever 38 acts on a mobile, plate-like member 43 to cause it to pivot about the axis of rotation 3 of disks 1*a* and 1*b*, but a different pivotal point would also suit. To this end, member 43 has a pin 44 that fits into an elongated opening 45 in lever 38. On moving from its rest position to its terminal position, lever 38 causes member 43 to rotate about 80°.

Pin 44 further carries a pawl 46 formed at one end formed with a tooth 47 directed towards axis 3. In the inoperative position of lever 38, the other end of pawl 46 bears against a surface 48 of the correcting mechanism's frame so as to place pawl 46 in a position where tooth 47 is remote from axis 3. When lever 38 starts pivoting in response to the action of push-piece 36, pawl 46 leaves this position and rotates in a direction that will bring tooth 47 closer to axis 3 under the action of an elastic blade 49 that is solid with member 43 and which bears on pawl 46.

Actuating mechanism 35 further comprises a toothed control wheel 50 concentric with pivotal member 43, i.e. with axis 3 in the present instance. Wheel 50 has an external toothing 51 which cooperates with pawl 46 and the clutch mechanism 37. When correcting lever 38 is in its inoperative position, the pawl's tooth 47 is clear of toothing 51. But as soon as lever 38 leaves its inoperative position to move to its terminal position, pawl 46 rocks under the action of elastic blade 49 and tooth 47 penetrates toothing 51. Toothed wheel 50 is then rotated through the same angle as pivotal member 43 by correcting lever 38. When this rotation of wheel 50 is completed, pawl 46 slips over toothing 51 as lever 38 is being returned to its inoperative position.

Figure 5:
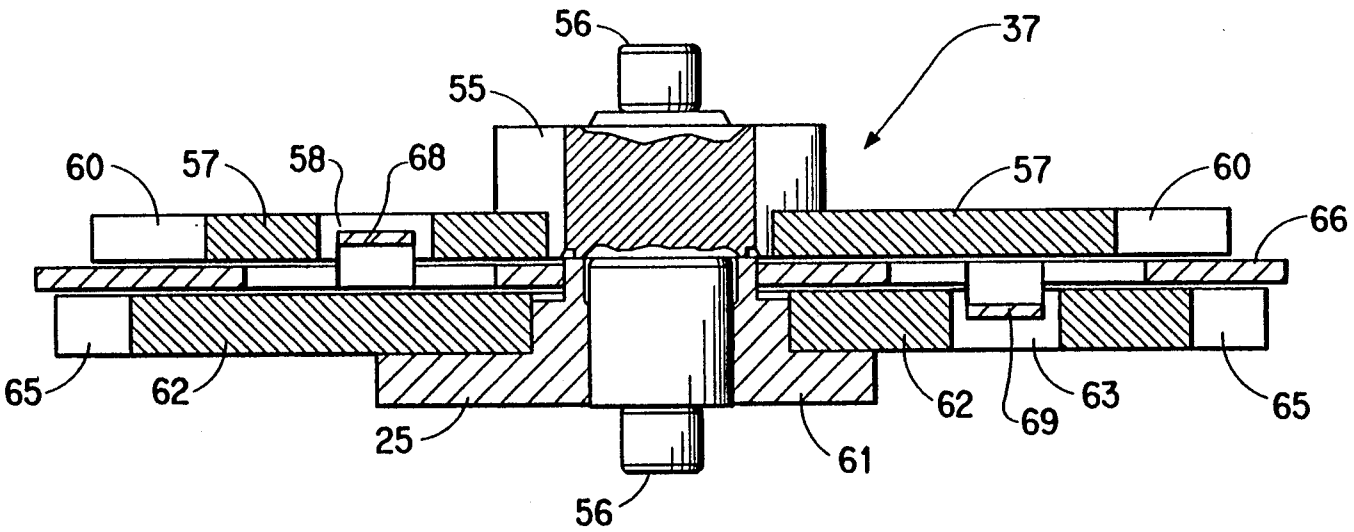
FIG. 5 is a sectional view along axis V—V of a clutch device forming part of the correcting mechanism shown in FIG. 4.

Clutch mechanism 37, which is shown in cross-section along line V—V of FIG. 5, takes the place of the second toothed wheel 11 to provide a link between, on the one hand, toothed wheels 11 and 50, and, on the other hand, the remainder of the display device. To this end, toothing 51 meshes with a pinion 55 solid with an arbor 56 rotatably mounted in openings provided in the time-piece movement or in the frame of the correcting mechanism, both not shown. On pinion 55 is fitted an upper toothed wheel 57 formed with a pair of diametrically opposite openings 58 and 59 (FIG. 4) and with an outer toothing 60 that meshes with the intermediate wheels 12*a* and 12*b* of the display device instead of with the toothed wheel 11. On arbor 56 is also fitted a rotary member 61 provided with a catch 25 similar to that of wheel 11. Member 61 also has a central cylindrical bearing and a radial shoulder for supporting a lower toothed wheel 62. Wheel 62, which can pivot freely on member 61, is formed with a pair of diametrically opposite openings 63 and 64 (FIG. 4) and an outer toothing 65 meshing with the first toothed wheel 10.

Between upper and lower toothed wheels 57 and 62 is provided a clutch disk 66 in which are cut two pairs of diametrically opposite flexible blades 67, 69 and 68, 70 (FIG. 9). Blades 68 and 70 are so arranged and bent as, firstly, to penetrate openings 63 and 64, and, secondly, to bear against the edges of these openings to enable wheel 62, driven by wheel 10, to drive in turn disk 66. Similarly, blades 67 and 69 are bent to enter openings 58 and 59 to enable disk 66 to drive wheel 57, while still enabling wheel 57 to rotate in the same direction as wheel 62, but more rapidly, because of the flexibility of the blades. Wheels 57 and 62 and disk 66 thus together form a unidirectional clutch. To ensure that the blades of disk 66 only enter the corresponding openings of wheels 57 and 62 once per complete revolution of wheel 57 in relation to wheel 62 to activate the clutch, the openings in each wheel and the corresponding blades are placed at different distances from arbor 56 (FIG. 4). In the present case, openings 59, 63 and blades 69, 68 are closer to the axis of rotation of wheels 57 and 62 than openings 58, 64 and blades 67, 70.

Thus, besides the corrective actions of disks 1*a*, 1*b* by push-piece 36, toothed wheel 10 drives wheels 12*a* and 12*b* and cam 20 by means of the above-described clutch mechanism, in the same way as it did via toothed wheel 11.

But during an action to correct disks 1*a* and 1*b*, when lever 38 moves from its inoperative position to its terminal position, wheel 50 drives pinion 55 in rapid rotation, in the same direction as wheel 62, pinion 55, wheel 57 and rotary member 61 with its catch 25, with wheel 57 slipping over clutch disk 66 to leave wheel 62 at rest. The ratio between the number of teeth on wheel 50 and the number of teeth on pinion 55 is set to enable pinion 55 to complete, in this embodiment, a full revolution at each corrective action, to cause the display device to move forward one step, i.e. from one day of the month to the next in the case of a calendar.

For the operation of the correction mechanism to be reliable, pinion 55 must in fact rotate, each time push-piece 36 is actuated, through 360 degrees plus an angular margin of safety to take into account play and manufacturing tolerances. This angular margin of safety, typically of about 10 degrees, is not critical but if it is too big there is a likelihood of the display device moving forward two steps, i.e. the step it will normally be required to take later, plus the corrective step.

The above-described display device and correction mechanism may of course be modified in various other ways that will be self-evident to persons skilled in the art, leading to different embodiments but without departing from the scope of the invention.

I claim:

1. A display device in or for use in a timepiece having an analog movement and comprising an upper disk (1*a*) having a transparent window (4) and which is located behind a cover plate having an aperture (2), a lower disk (1*b*) concentric with the upper disk, said upper disk covering at least partially the lower disk of which a portion is visible through said window, means (10, 11, 12*a*, 12*b*, 13*a*, 13*b*) for rotatably driving step by step each disk about an axis (3) in a given direction from a rotary element of the timepiece's movement, and means (30*a*, 30*b*, 31*a*, 31*b*) for positioning said disks, characterized in that:

the upper disk (1*a*) is divided into n+1 equal and adjacent sectors respectively designated by the numbers 0', 1' . . . , n' such as to travel past the aperture (2) in ascending number order behind the cover plate when the disk rotates in one of the given directions, sector 0' having the window and the other sectors bearing distinguishing symbols;

the lower disk (1*b*) is divided into m equal and adjacent sectors bearing distinguishing symbols respectively designated by the numbers 1", 2" . . . , m" such as to travel past the aperture (2) in ascending number order behind the upper disk (1*a*) when the lower disk (1*b*) rotates in the other given direction;

the means (10, 11, 12*a*, 12*b*, 13*a*, 13*b*) for driving the disks (1*a*, 1*b*) are arranged, starting from an initial position in which sectors 0' and m" are in register with the aperture:

a) to move the upper disk (1*a*) forward by n+1 successive one-sector steps to cause the n sectors 1', 2', . . . , n' to travel past the aperture (2) behind the cover plate, and to reset the sector 0' in the starting position after a complete revolution of the disk, b) to move the lower disk (1*b*), while the upper disk (1*a*) is moving, by one one-sector step such that the sector 1" will find itself opposite the aperture (2), at the same time as the sector 0', at the end of the complete revolution of the upper disk, and c) to move only the lower disk (1*b*) by m−1 successive one-sector steps to cause the sectors 2", 3" . . . , m" forward by m−1 additional steps and to return to the initial position.

2. A display device as in claim 1, wherein said disk driving means (10, 11, 12*a*, 12*b*, 13*a*, 13*b*) comprise:

a gear-train including a) a first toothed wheel (10) driven off a rotary staff of the timepiece's movement, b) a second toothed wheel (11) meshing with the first toothed wheel, c) first and second intermediate toothed wheels (12*a*, 12*b*) each meshing with said second wheel, d) first and second toothed driving wheels (13*a*, 13*b*) respectively meshing with said first and second intermediate wheels (12*a*, 12*b*) and each having at least one finger (16*a*, 16*b*), said driving wheels being free to move towards said axis (3) to occupy an operative position or an inoperative position, e) n+1 evenly spaced toothed sectors (18*a*) on the inner perimeter of the upper disk (1*a*), each having at least one tooth, the finger (16*a*) of the first driving wheel (13*a*) meshing with a tooth of one of said toothed sectors to cause the upper disk to move forward one one-sector step at each revolution of the first driving wheel when said wheel is in its operative position, and leaving the upper disk immobile when said first driving wheel is in its inoperative position, f) m evenly spaced toothed sectors (18*b*) on the inner perimeter of the lower disk (1*b*), each having at least one tooth, the finger (16*b*) of the second driving wheel (13*b*) meshing with a tooth of one of said toothed sectors to cause the lower disk to move forward one one-sector step at each revolution of the second driving wheel when said wheel is in its operative position, and leaving the lower disk immobile when said second driving wheel is in its inoperative position; and control means (20, 22, 23) activated by said movement and arranged to place said first toothed driving wheel (13*a*) and said second toothed driving wheel (13*b*) in their operative or inoperative position depending on whether the upper disk and the lower disk are required, respectively, to move a step or to remain immobile.

3. A display device as in claim 2, wherein said control device comprises a rotary annular cam (20) concentric with the upper and lower disks (1*a*, 1*b*) and including:

n+m teeth (21) evenly spaced on its inner perimeter which mesh with a catch (25) so arranged on the second toothed wheel (11) that the disk moves forward by one tooth at each revolution of said wheel, and a control track (22, 23) that cooperates with the toothed driving wheels to position said wheels in their operative or inoperative position depending on the angular orientation of the cam, said control track (22, 23) being so arranged that:

a) the first and second toothed driving wheels (13*a*, 13*b*) are in their operative position in the initial position of the upper and lower disks (1*a*, 1*b*) to cause the two disks to move forward during the first step, b) the first driving wheel (13*a*) is in its operative position and the second driving wheel (13*b*) is in its inoperative position during the n following steps to cause only the upper disk (1*a*) to move forward by n additional steps, and c) the first driving wheel (13*a*) is in its inoperative position and the second driving wheel (13*b*) is in its operative position during the m−1 following steps to cause only the lower disk (1*b*) to move forward by m−1 additional steps and to return to the initial position.

4. A display device as in claim 3, wherein each of said toothed driving wheels (13*a*, 13*b*) has a staff (14*a*, 14*b*) located in an elongated opening (15*a*, 15*b*), said opening being so oriented as to enable each of said wheels to occupy a position remote from or close to the axis of rotation (3) of the upper and lower disks, and wherein the control track is formed by the cam's outer periphery against which the staffs of the driving wheels are urged by a spring (17*a*, 17*b*), said perimeter including first and second circular control sectors (22, 23), the radius of the second sector (23) being smaller than that of the first sector (22), said sectors being so arranged that, depending on whether the staff of a driving wheel bears against the first or second sector, said wheel is in its operative or inoperative position respectively.

5. A display device as in claim 3, which further comprises a jumper (26) to angularly position the cam (20) by cooperating with the teeth (21) on its inner perimeter.

6. A display device as in claim 2 wherein the means for positioning the upper and lower disks (1*a*, 1*b*) include, for each disk:

a unidirectionally acting jumper (30*a*, 30*b*) that allows the disk to rotate freely in said given direction, and that prevents it from rotating in the opposite direction by bearing against a tooth of one of said toothed sectors (18*a*, 18*b*), and a rocking lever (31*a*, 31*b*) which, when moved to a first position by an elastic member (32*a*, 32*b*), prevents the disk (1*a*, 1*b*) from rotating in said given direction by bearing against a tooth of one of said toothed sectors (18*a*, 18*b*) and which, when moved to a second position by a finger (33*a*, 33*b*) of the corresponding driving wheel (13*a*, 13*b*), but only when said wheel is in its operative position, is moved away from the disk (1*a*, 1*b*) to disengage the teeth of the toothed sectors (18*a*, 18*b*) and to enable said disk to move by one step.

7. A display device as in claim 2, wherein said first toothed wheel (10) is solid with the hours staff of the timepiece's movement.

8. A display device as in claim 1, wherein the upper and lower disks (1*a*, 1*b*) have each sixteen sectors, sectors 1' to 15' respectively bearing numerals 1 to 15 and sectors 1'', 2'', 3'', . . . , 16'' respectively bearing numerals 16, 17, 18, . . . , 31 to indicate the successive days of a 31-day month.

9. A display device as in claim 1, which further comprises means for rapidly correcting the position of said disks (1*a*, 1*b*).

10. A display device as in claim 9, wherein said correcting means include:

a control mechanism (35) responsive to the action of an external push-piece (36), and a rotary, unidirectional clutch mechanism (37) replacing said second toothed wheel (11) and arranged to rotate said first and second intermediate toothed wheels (12*a*, 12*b*) and the cam (20) either in normal manner via said first driving wheel (10) or in accelerated manner via the control mechanism (35), through the angle required for one or both disks, depending on the position of said disks (1*a*, 1*b*), to move one step.

11. A display device as in claim 10, wherein said control mechanism (35) includes:

a correcting lever (38), said push-piece (36) acting on one end of said lever to pivot it about an arbor (39) from a rest position to a terminal position, a control wheel (50) having peripheral toothing (51), and a unidirectionally acting pawl (46) which cooperates with said toothing (51) of the control wheel (50) and with the other end of said correcting lever (38) to rotate said control wheel through a given angle when the lever moves from the rest position to the terminal position, and which disengages said toothing (51) when said lever (38) is in its rest position.

12. A display device as in claim 11, wherein said clutch mechanism (37) includes:

a toothed pinion (55) fixedly mounted on an arbor (56) and which meshes with the toothing (51) of said control wheel (50), a rotary member (61) solid with the arbor (56) of said pinion (55) and which has a catch (25) for driving said cam (20), an upper toothed wheel (57) solid with said pinion (55) and which has an axial opening (58, 59) and a peripheral toothing (60), said peripheral toothing meshing with said first and second intermediate toothed wheels, a lower toothed wheel (62) freely rotating on said rotary member (61) and which has an axial opening (63, 64) and a peripheral toothing (65), said peripheral toothing meshing with said first toothed wheel (10), and a clutch disk (66) freely rotating between said upper and lower wheels and having two flexible blades (67, 68; 69, 70), one of said blades (67, 69) entering the opening (58, 59) of the upper wheel (57) and the other blade (68, 70)entering the opening (63, 64) in the lower wheel (62) whereby the lower wheel drives the upper wheel via the clutch disk (66), while still enabling said upper wheel to rotate in accelerated manner, in the same direction as the lower wheel, during rapid correction of the position of said disks (1*a*, 1*b*).

13. A display device as in claim 3, wherein said correcting means include:

a control mechanism (35) responsive to the action of an external push-piece (36), and a rotary, unidirectional clutch mechanism (37) replacing said second toothed wheel (11) and arranged to rotate said first and second intermediate toothed wheels (12*a*, 12*b*) and the cam (20) either in normal manner via said first driving wheel (10) or in accelerated manner via the control mechanism (35), through the angle required for one or both disks, depending on the position of said disks (1*a*, 1*b*), to move one step.

* * * * *